United States Patent [19]

Tucker

[11] 4,162,013

[45] Jul. 24, 1979

[54] BOOK RACK

[75] Inventor: Larry H. Tucker, Engelwood Cliffs, N.J.

[73] Assignee: Concepts For Children, Inc., Englewood Cliffs, N.J.

[21] Appl. No.: 875,340

[22] Filed: Feb. 6, 1978

[51] Int. Cl.[2] ..... A47B 65/00

[52] U.S. Cl. ..... 211/43; 211/184; 211/189

[58] Field of Search ..... 211/41–43, 211/184, 49 R, 57.1, 59.1, 186, 194, 11, 189, 201; 248/221.3, 221.4

[56] References Cited

U.S. PATENT DOCUMENTS

| | | | |
|---|---|---|---|
| 1,660,823 | 2/1928 | Thometz | 211/43 |
| 2,620,929 | 12/1952 | Sportsman | 211/43 |
| 3,154,281 | 10/1964 | Frank | 248/221.4 |
| 3,171,542 | 3/1965 | Jacobs et al. | 211/43 |
| 3,255,987 | 6/1966 | Gatch | 211/184 X |
| 3,858,529 | 1/1975 | Salladay | 211/186 |

FOREIGN PATENT DOCUMENTS

| | | | |
|---|---|---|---|
| 261537 | 11/1926 | United Kingdom | 211/43 |

*Primary Examiner*—Thomas J. Holko
*Attorney, Agent, or Firm*—Howard I. Schuldenfrei

[57] ABSTRACT

An adjustable rack for books is provided which includes a pair of supports aligned in parallel spaced relationship and a pair of end plaques removably mounted on the supports. Each end plaque lies in a plane normal to the plane of the supports. One end plaque is mounted in a fixed position on a corresponding pair of ends of the supports, while the other end plaque is movably mounted on the supports relative thereto. The longitudinal body of each support includes symmetrically aligned radially extending ribs, and each support terminates in discrete pairs of legs having outwardly turned feet, which releasably engage a plaque on the support. A pair of corresponding ends of the respective supports are gusseted for the purpose of releasably fixing the position of one of the end plaques on the supports.

6 Claims, 6 Drawing Figures

FIG. 1
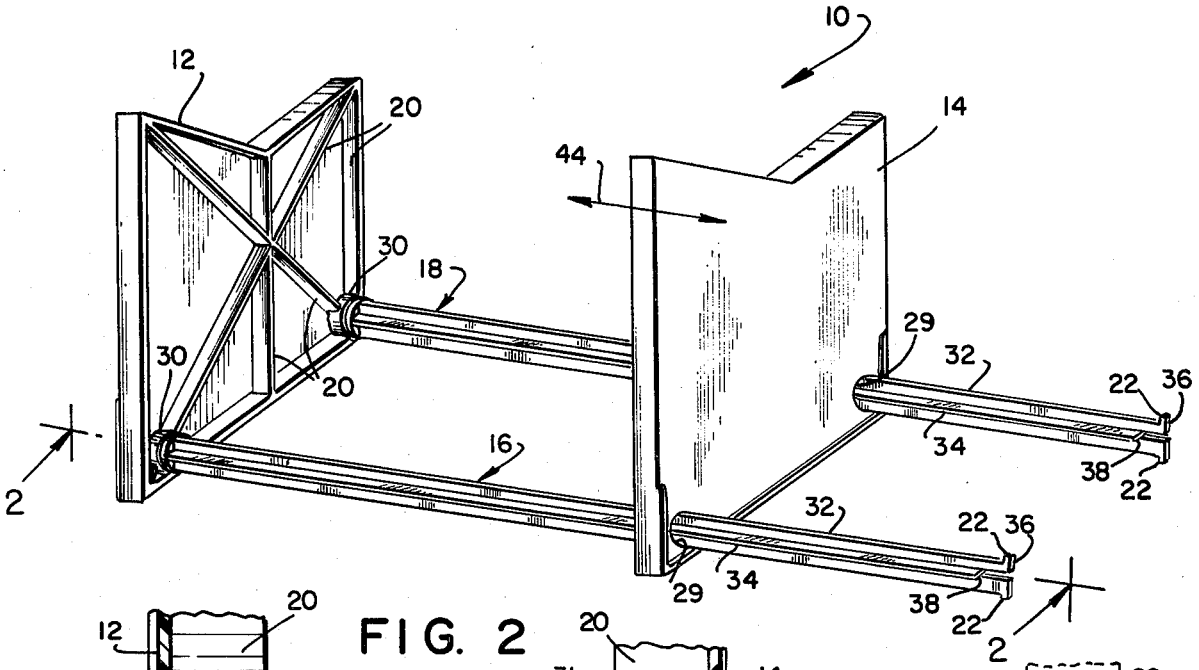
FIG. 2
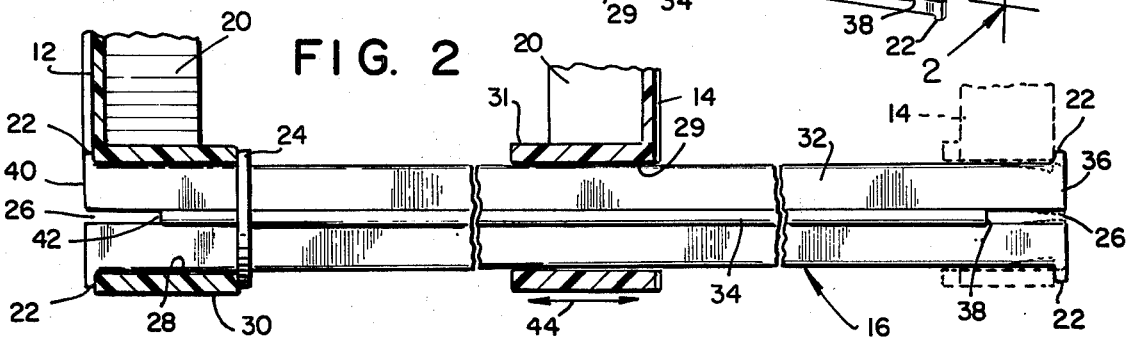
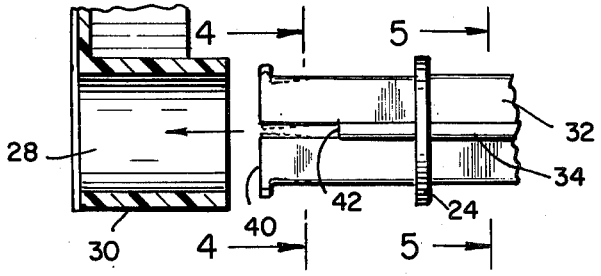
FIG. 3
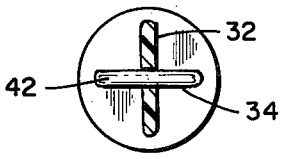
FIG. 4
FIG. 5
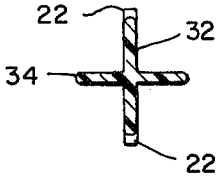
FIG. 6
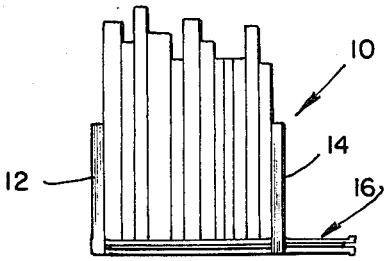

BOOK RACK

BACKGROUND OF THE INVENTION

The instant invention relates generally to portable racks and, more particularly, to an adjustable rack for books or the like which may be adjusted to securely accommodate less than a maximum number of books or like objects, such as phonograph records.

Adjustable racks for books and like objects are known in the art. However, in prior rack designs having adjustable end plaques, the end plaques are too loosely slideably mounted on the supports to securely maintain books, for instance, mounted on the rack in a manually set position. In these designs, the weight of the books against the end plaques tends to slide the end plaques outwardly along the supports until the books fall from their set position. Another type of prior book rack includes fixed end plaques and a pair of intermediate slideable plaques provided with friction bearing surfaces for increased stability after placement. This latter type of rack construction increases the weight and cost of each unit. In still other types of racks of the type including locking devices, these locking devices have frequently been difficult to manipulate, subject to breakdown and have been costly to fabricate and have detracted from the aesthetic appearance of the unit.

SUMMARY OF THE INVENTION

Generally speaking, in accordance with the invention, an adjustable rack for books is provided which includes a pair of supports aligned in parallel spaced relationship and a pair of end plaques removably mounted on the supports. Each end plaque lies in a plane normal to the plane of the supports. One end plaque is mounted in a fixed position on a corresponding pair of ends of the supports, while the other end plaque is movably mounted on the supports relative thereto.

The longitudinal body of each support includes symmetrically aligned radially extending ribs, and each support terminates in discrete pairs of legs having outwardly turned feet, which releaseably engage a plaque on the support. A pair of corresponding ends of the respective supports are gusseted for the purpose of releasably fixing the position of one of the end plaques on the supports.

It is a significant feature of the invention that the unit can be broken-down and compacted for storage. Each end plaque may be released from the supports with facility.

Accordingly, it is an object of this invention to provide an improved rack for books or the like.

Another object of the invention is to provide a rack for books or the like which may be broken-down and reassembled with facility.

A further object of the invention is to provide a rack for books or the like having one end plaque movable relative to another.

Still another object of the invention is to provide an improved mounting for book rack end plaques on supports which are resilient yet sufficiently firm to secure objects mounted therein in a relatively fixed position.

Still other objects and advantages of the invention will in part be obvious and in part be apparent from the Specification.

The invention accordingly comprises the features of construction, combinations of elements, and arrangement of parts which will be exemplified in the constructions hereinafter set forth, and the scope of the invention will be indicated in the Claims.

BRIEF DESCRIPTION OF THE DRAWINGS

For a fuller understanding of the invention, reference is had to the following description taken in connection with the accompanying drawing, in which:

FIG. 1 is a perspective view of a rack constructed in accordance with the invention;

FIG. 2 is a sectional view of the rack seen in FIG. 1 taken along line 2—2 of FIG. 1;

FIG. 3 is a fragmentary detail view showing the assembly and disassembly of the support and end plaque seen in FIG. 2;

FIG. 4 is a cross sectional view of the support seen in FIG. 3 taken along line 4—4 of FIG. 3;

FIG. 5 is a cross sectional view of the support seen in FIG. 3 taken along line 5—5 of FIG. 3; and FIG. 6 is an isometric view showing the mode of operation of the rack constructed in accordance with the instant invention.

DETAILED DESCRIPTION OF THE INVENTION

Referring now to the drawing, and particularly to FIG. 1 thereof, the assembled book rack 10 depicted, which is constructed according to the instant invention, includes a pair of parallel aligned supports 16 and 18, and a corresponding pair of parallel aligned end plaques 12 and 14 which are normally removably mountable thereon. As best seen in FIGS. 1, 2 and 6 in the assembled unit, end plaque 14 is slideably mounted on supports 16 and 18 and telescopes thereon relative to end plaque 12. The relative positions of end plaques 12 and 14 on supports 16 and 18 may be reversed without altering the manner of operation of the assembly.

End plaques 12 and 14 are of identical construction and each end plaque is a substantially planar plastic web having, in relative arrangement in the rack assembly, an interior surface reinforced with a plurality of support bearings 20 which laterally encompass the perimeter of the web and radially extend thereon. A lip flange extends outwardly at least along the bottom edge of the plaque in a plane substantially normal to the web.

Formed in the web of each end plaque 12 and 14 are corresponding pairs of reinforced mirror-image substantially cylindrically shaped plastic channel members 30 and 31 extending outwardly from the respective interior surfaces of end plaques 12 and 14. Each such channel member 30 and 31 defines a corresponding substantially cylindrical channel 28 and 29 therein in respective end plaques 12 and 14, said channels 28 and 29 extending through respective end plaques 12 and 14 in a direction generally normal to the plane of each plaque. The channels are in definite alignment with each other, and with their corresponding mirror-images in the second end plaque. Channel members 30 and 31 provide journals for releasably mounting end plaques 12 and 14 on supports 16 and 18.

Supports 16 and 18 are of identical construction as seen in FIG. 1, each comprising an elongated web of resilient plastic material having radial longitudinally extending pairs of support bearings formed by the intersection of substantially planar webs 32 and 34 at relative normals to each other, as best seen in FIG. 5. Opposite ends 38 and 42 of planar web 34 are cropped relative to corresponding opposite ends 36 and 40 of planar web 32. Axial interiorly extending slots 26, defined by a separation in the support bearings determined in planar web 32 and respective opposite ends 38 and 42 of planar web 34, are formed in corresponding respective opposite ends of supports 16 and 18, and define concomitant corresponding pairs of legs on opposite ends of each support.

The pairs of legs formed in planar web 32 terminate in corresponding opposite pairs of feet having linear exteriorly arranged formed uppers 22 and opposite outer ends 36 and 40, respectively, generally normal to planar web 34. Formed interiorly on each support 16 and 18 in definite spaced relationship to end 40 is a gusset 24 comprising a disc integrally formed in the support, diametrically intersected by planar webs 32 and 34 and having a diameter greater than either planar web 32 or 34.

As best seen in FIGS. 1, 2 and 3, the widths of planar webs 32 and 34 of supports 16 and 18 definitely correspond with the diameter of a circular cross-section through corresponding channels 28 and 29 in respective end plaques 12 and 14, and each support may be journalled into a corresponding pair of channel members 30 and 31 in respective end plaques 12 and 14. Each pair of uppers 22 on an end of a support have a combined height which generally corresponds dimensionally to the depth of planar web 34, each upper 22 having a generally rounded outer edge on which it may be cammed through a channel member 30 and 31 of end plaques 12 and 14.

To assemble the unit, as seen in FIG. 1, opposite ends of each support are journalled through a corresponding pair of channel members 30 and 31. Ends of a support are registered with a corresponding pair of channels 28 and 29. Manual pressure is applied to introduce the ends of each support through an end plaque channel. As seen in phantom line in FIGS. 2 and 3, the legs to which uppers 22 are integrally connected are depressed inwardly through slot 26 as each end of the support is journalled through a channel member. An end plaque is fully mounted on a support when, as seen in FIG. 2, uppers 22 have emerged through the channel, for instance a channel 28 and abut the planar surface of the end plaque, for instance end plaque 12.

As seen in FIG. 1, the gusseted ends of supports 16 and 18 are usually aligned and removably mounted in the same end plaque, for instance end plaque 12, thereby fixing the position of that end plaque relative to the other in the assembled rack. The distance between a pair of uppers 22 and their proximate gusset 24 must be only sufficient to accommodate a channel member, for instance channel member 30, abutted at opposite ends by uppers 22 and gusset 24, respectively. As mounted, the other end plaque, for instance end plaque 14, is slidable relative to, for instance end plaque 12, as shown by directional arrow 44, and the distance between end plaques 12 and 14 may be manually adjusted to accommodate various numbers of books up to a predetermined maximum, as determined by the distance between opposite pairs of uppers 22 on the supports.

The support bearing surfaces of the slidable end plaque frictionally abut the interior surface of the channel members of that end plaque, and this feature contributes to the vertically fixed stability of the slidable end plaque. When books are mounted on supports 16 and 18 in the assembled rack, end plaque 14, for instance, is moved until its interior surface abuts the cover of the outer book, as seen in FIG. 6. The pressure of mounted books against end plaque 14 levers the lip flange provided along its bottom edge into the level support surface for the assembly, and a fulcrum braking effect is provided which prevents self-extension of the slidable plaque under the force of mounted books.

To prevent books from toppling from the assembly even when an interiorly mounted book is removed from a group standing on the supports, the supports are arranged to provide horizontal and vertical alignment among corresponding webs of the supports. Each mounted book is provided with a pair of opposite corners in which to nest and a pair of horizontal load bearing surfaces over which its weight is distributed.

End plaques 12 and 14 may be interchangeably mounted on supports 16 and 18. Disassembly of the unit is accomplished by reversing the assembly procedure. The unit may be cast molded of a large variety of conventional plastics, or fabricated from other well-known resilient materials. The unit may be packaged in compact disassembled form, and may be assembled with facility.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An adjustable rack assembly for books or like items comprising first and second supports alignable in parallel spaced relationship; and corresponding first and second end plaques removably mountable on first and second supports, respectively; said first and second end plaques being mountable on each of said first and second supports each extending substantially normal to a plane through said first and second supports; each of said first and second end plaques comprising a substantially planar plastic web having first and second major planar surfaces, each in a plane substantially parallel to its respective web, and each web including corresponding first and second channel members having respective first and second channels therein, said first and second supports being introduceable into said channels for mounting each of said first and second end plaques on said first and second supports; said first and second supports including first means cooperable with said first and second channel members on said first and second end plaques for releasably engaging opposite ends of said first and second supports, respectively, to said first and second end plaques, said means comprising respective discrete pairs of resilient legs mounted on each end of each of said first and second supports, and corresponding pairs of feet emergent from said legs, said feet being aligned and emergent at relative normals to said legs, each of said discrete pairs of legs having a slot defined therebetween, said respective feet of each discrete pair having a distance therebetween which exceeds the height of each of said channels, said respective discrete pairs of legs having a flex characteristic under a linearly applied pressure for introduction of said discrete pairs of resilient legs through a respective channel in said end plaques, each of said feet having a cammed surface corresponding to a cam profile of said channel; and said first and second supports including second means cooperable with said first means for fixing the position of said first end plaque on said first and second supports, said second end plaque being slidable on said first and second supports and telescopable thereon relative to said first end plaque.

2. The adjustable rack assembly as claimed in claim 1, said second means comprising first and second gussets mounted respectively on said first and second supports proximate corresponding ends thereof in specific predetermined spaced relation relative to said corresponding ends.

3. The adjustable rack assembly as claimed in claim 1, said first and second end plaques including corresponding pluralities of symmetrically arranged support bearings mounted, respectively, on said second major surface of each of said webs for reinforcing said webs.

4. The adjustable rack assembly as claimed in claim 1, each of said first and second end plaques including a respective lip flange formed substantially at a normal to said webs, said lip flanges extending at least along the bottom edges of each of said webs.

5. The adjustable rack assembly as claimed in claim 1, each of said first and second supports including plural load bearing surfaces, and corresponding plural support bearing surfaces.

6. The adjustable rack assembly as claimed in claim 1, said first and second supports each comprising corresponding elongated first and second webs of resilient plastic materials including plural radially extending pairs of support bearings formed by the intersection of substantially planar webs at relative normals to each other.

* * * * *